United States Patent [19]

Mathew

[11] Patent Number: 4,512,099

[45] Date of Patent: Apr. 23, 1985

[54] GUN LOCKING DEVICE

[76] Inventor: Ronald G. Mathew, 11763 Willow Valley Rd., Nevada City, Calif. 95959

[21] Appl. No.: 583,521

[22] Filed: Feb. 24, 1984

[51] Int. Cl.[3] ..... F41C 27/00

[52] U.S. Cl. ..... 42/1 LP

[58] Field of Search ..... 42/1 LP

[56] References Cited

U.S. PATENT DOCUMENTS

| | | | |
|---|---|---|---|
| 2,478,098 | 8/1949 | Hansen | 42/1 LP |
| 2,479,107 | 8/1949 | Garretson | 42/1 LP |
| 2,887,807 | 5/1959 | Santangelo | 42/1 LP |
| 3,154,874 | 11/1964 | Stewart | 42/1 LP |
| 3,193,959 | 7/1965 | Jaycox | 42/1 LP |
| 4,479,320 | 10/1984 | Fix | 42/1 LP |

*Primary Examiner*—Charles T. Jordan

*Attorney, Agent, or Firm*—Lothrop & West

[57] ABSTRACT

A diagonally split sleeve affords a pair of wedges at least one of which is laterally displaced when the wedges are urged together. By locating the wedges in the firing chamber of a gun, the gun is rendered useless; and by positioning the wedges adjacent the tapered throat of the firing chamber, the lateral displacement, or expansion, can be taken advantage of to prevent unauthorized removal of the device. A cylinder lock and special cams attached to a tube and coaxial actuating rod extending through the gun barrel from the muzzle to the firing chamber serve to position and actuate the wedges only in response to operation of the lock key.

7 Claims, 6 Drawing Figures

GUN LOCKING DEVICE

BACKGROUND OF THE INVENTION

The present invention relates to new and useful improvements in firearm locks, particularly for guns, revolvers and automatic pistols.

Prior art known to applicant consists of U.S. Pat. Nos. 2,327,334; 2,479,107, 2,887,807, 3,022,598, 2,478,098, 3,360,880 and 4,023,294.

Although the prior art discloses several different ways in which to lock a gun, there is still considerable room for improvement.

SUMMARY OF THE INVENTION

A diagonally split sleeve is positioned within the firing chamber of a gun so that as the two wedge-shaped portions of the split sleeve are urged together, at least one of the portions is laterally displaced, resulting in positive interference, either with the tapered throat or with the lands at the start of the rifling of the barrel at the forward end of the throat. In locked position, the presence of the split sleeve in the chamber prevents the entry of an unfired cartridge into operative position within the chamber and the device cannot be withdrawn through the barrel since the effective transverse dimension of the expanded split sleeve exceeds the diameter of the barrel measured land to land. A cylinder lock cooperates with coupled cams to urge the split sleeve into expanded and locked position.

DETAILED DESCRIPTION OF A PREFERRED EMBODIMENT

Although usable with guns of substantially all calibers and barrel lengths, by the appropriate selection of dimensions, the device is especially suitable for handguns of various sizes.

Figure 2:
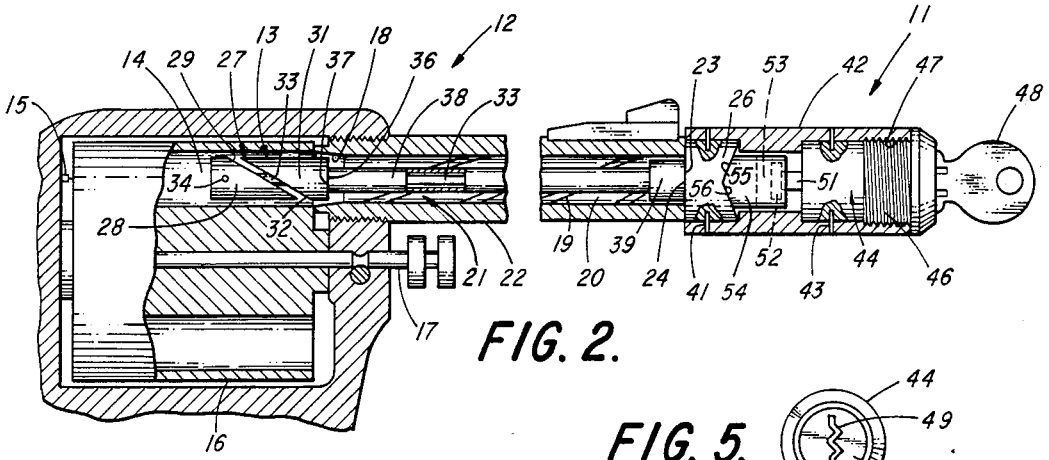
FIG. 2 is a fragmentary side elevational view, to an enlarged scale, showing the device in unlocked condition, with some portions of the gun shown in section and with other portions broken away to reduce the extent of the figure.
Figure 5:
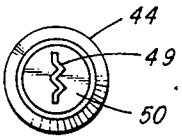
FIG. 5 is a front elevational view of the cylinder lock.
Figure 3:
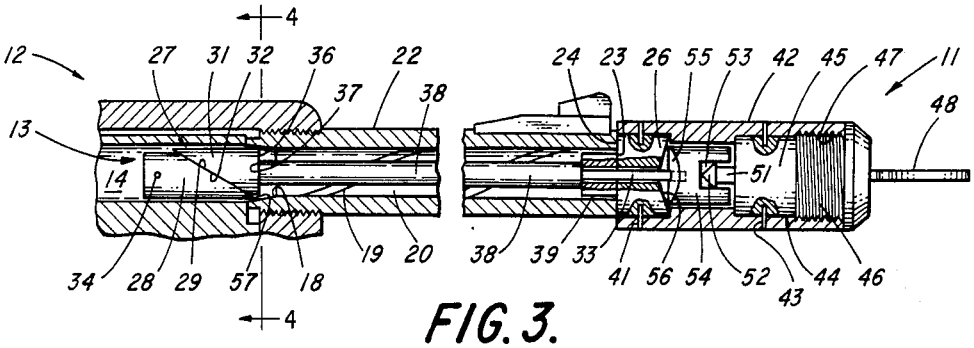
FIG. 3 is a fragmentary sectional view of the firing chamber and gun barrel, showing the device in locked condition.

The gun locking device of the invention, generally designated by the reference numeral 11, renders a gun 12, such as a revolver, useless when installed and locked, as in FIG. 3. This results from the fact that the after end 13 of the device occupies a large portion of the firing chamber 14, thereby making it impossible to load a cartridge in the chamber in register with the firing pin 15 (see FIG. 2).

The cylinder 16 is also immobilized by the device in installed condition since the after end 13 interferes with rotation of the cylinder about the customary shaft 17.

In well-known manner, the forward end of the firing chamber 14 merges into a forwardly tapered, or converging, throat 18, or freebore formed in the barrel 22; and adjacent the forward end of the throat is located the starting point of the lands 19 which, with the intervening grooves 20, form the rifling 21 extending through the barrel 22 to the muzzle 23.

In installed position, the planar after end 24 of a circular cylindrical plug 26 abuts the muzzle 23, which therefore serves as a limit stop determining the extent of penetration of the after end 13 of the device into the firing chamber 14.

The limit stop effect of the muzzle and plug abutment also accurately positions, relative to the throat 18, a diagonally split sleeve 27, or expander, comprising an after wedge-shaped portion 28, or after wedge, with a forwardly facing inclined surface 29; and a forward wedge-shaped portion 31, or forward wedge, with a rearwardly facing inclined surface 32.

The two wedges 28 and 31 encompass an axial rod 33, to which the after wedge 28 is anchored by a hollow pin 34. The central bore 30 of the forward wedge 31 is enlarged somewhat so as to encompass the rod 33 loosely, with clearance between the rod 33 and the bore walls of the forward wedge 31.

In most instances, the front end 36 of the forward wedge 31 abuts the after end 37 of a tube 38 loosely encompassing the rod 33 to permit translation of the rod 33 relative to the tube 38.

In order to assist in axially centering the tube 38 and rod 33 in the barrel 22, the front end portion of the tube is coaxially mounted on a centering collar 39, or boss, the collar 39 having a diameter enabling the collar to fit snugly in the muzzle end of the barrel 22.

The collar 39 and the tube 38 are secured coaxially on the after end 24 of the circular cylindrical plug 26; and the plug 26, in turn, is coaxially anchored, by a pin 41, to a hollow, generally circular cylindrical, elongated housing 42. As in the case of pin 34, the anchor pin 41 is of hollow, deformable construction which, when driven into the hole in the base member (i.e. the rod 33 in the case of the pin 34, and the plug 26 in the case of the pin 41) is countersunk and is extremely difficult to remove.

In like manner, a non-removable pin 43 anchors a coaxial cylinderlock 44 in the forward end of the housing 42, thereby preventing tampering and unscrewing of the lock threads 46 in engagement with the threads 47 of the housing 42.

Conveniently, rotation of the lock 44 between locked position and unlocked position is effected by a key 48 insertable in the usual keyhole 49 in the exposed face 50 of the lock 44.

Installation of the device is accomplished by first inserting the tube 38 in the gun barrel 22 until the collar 39 is seated in the muzzle end of the barrel and the plug abuts the muzzle 23.

At this juncture, as most clearly appears in FIG. 2, the after wedge 28 and the forward wedge 31 are positioned approximately in the registered location shown, although the respective opposed sloping surfaces 29 and 32 would ordinarily be somewhat closer than as illustrated in FIG. 2, where the separation is exaggerated to disclose the rod 33 more clearly.

To lock the device, the key 48 is rotated clockwise through an arc of about 90 degrees to the position shown in FIG. 3, thereby simultaneously rotating a coaxially projecting tang 51 and cross-bar 52 on the after end of the tang 51. The tang 51 and cross-bar 52, in other words, are rotated about 90 degrees since they are mounted on the after end of the usual lock cylinder inside the lock barrel 45.

The tang 51 and the cross-bar 52 are located in a fore and aft slot 53 in a coaxial circular cylindrical block 54 movable within limits in a fore and aft direction within the housing 42 as well as being rotatable in response to the torque exerted by the tang cross-bar 52 against the walls of the slot 53 as the lock cylinder is rotated by the key 48.

In unlocked condition, as shown in FIG. 2, the convex V-shaped, or male, cam face 55 at the after end of the cylindrical block 54 nests in the respective concave V-shaped, or female, cam face 56 of the plug 26. In this position, the cylindrical block 54 and the rod 33 secured coaxially to the block 54 are in their extreme rearward position; and, as appears in FIG. 2, the after wedge 28 is in its extreme rearward position.

When, however, the key 48, the lock cylinder, the tang 51 and the cross-bar 52 are rotated 90 degrees, the cross-bar 52 rotates the cylindrical block 54 through 90 degrees, thereby causing the convex block face 55 to ride up the slopes of the concave plug face 56 to assume the separated position of the two cams shown in FIG. 3. Since the convex block face 55 moves forwardly, away from the concave plug face 56, the rod 33 and the after wedge 28 are likewise urged in a forward direction.

Forward urgency of the after wedge 28 results in a forward and transverse biasing effort imposed on the forward wedge 31, as the forwardly facing sloping surface 29 of the after wedge 28 engages the rearwardly facing sloping surface 32 of the forward wedge 31.

However, as soon as the front end 36 of the forward wedge 31 encounters the after end 37 of the tube 38, the forward wedge 31 can no longer be moved axially; and being squeezed between the low slope 29 of the after wedge 28 and the transverse after end 37 of the tube 38, the forward wedge 31 is constrained to move transversely as a result of the transverse components provided by the sloping interfaces 29 and 32.

As a consequence, the leading perimeter of the forward wedge 31 is biased transversely into engagement with the adjacent wall of the tapered throat 18, or freebore. Ordinarily, the dimensions of the components are selected so that engagement occurs in the vicinity of the base, or start, of one or more of the lands 19 at the aftermost end of the rifling 21 where the lands 19 commence to "rise" from the area adjacent the forward end of the throat 18.

Figure 1:
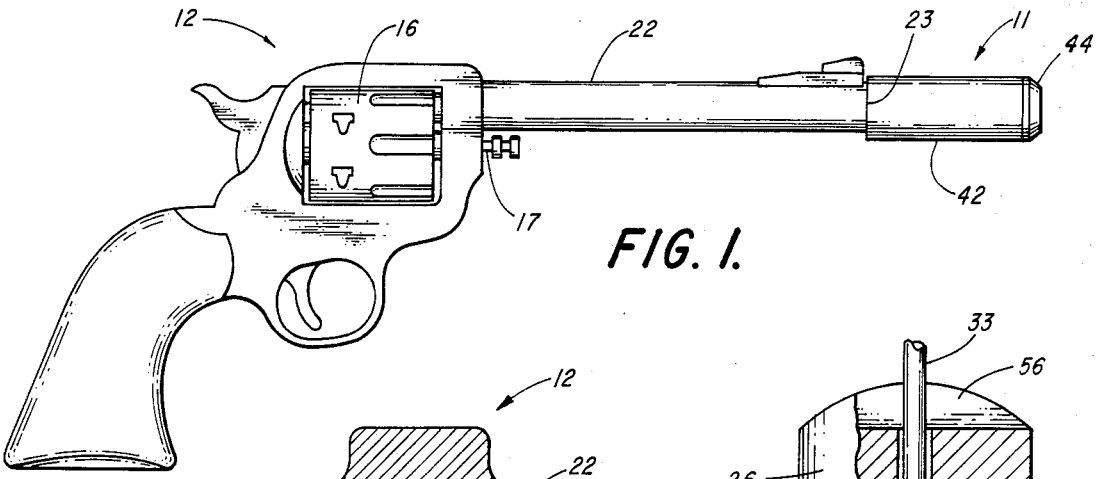
FIG. 1 is side elevational view of a typical handgun with a preferred embodiment of the invention installed thereon.
Figure 4:
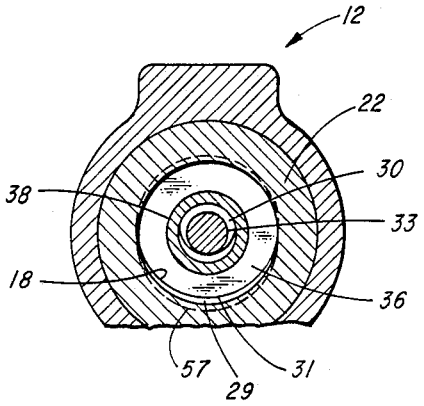
FIG. 4 is a fragmentary transverse sectional view, to an enlarged scale, taken on the line 4—4 in FIG. 3.
Figure 6:
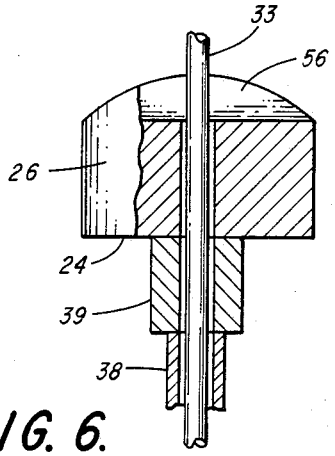
FIG. 6 is a side elevational view to an enlarged scale, of the plug formed with the female cam surface, the plug being rotated 90 degrees from the position shown in FIGS. 2 and 3, with portions shown in section.

The transverse displacement of the forward wedge 31 is made possible by the enlarged bore 30 in the forward wedge 31 which provides considerable clearance between the rod 33 and the bore walls. In the locked position shown in FIGS. 3 and 4, the forward wedge 31 is displaced slightly, transversely, from a true coaxial position.

In a somewhat comparable displacement, the after wedge 28 is frequently biased transversely in a direction opposite to that of the forward wedge 31, with the result that the after end of the rod 33 flexes by a small amount in the enlarged bore of the forward wedge 31 and causes the forward nose 57 of the after wedge 28 to engage the adjacent wall of the tapered throat, as appears in FIG. 3.

Thus, where the forward wedge 31 is free to shift transversely, both the forward wedge 31 and the after wedge provide an interference which prevents withdrawal or removal of the locking device from the gun until the key 48 is again inserted and rotated 90 degrees in a counterclockwise direction, causing the convex cam face 55 to nest again against the concave cam face 56, and move the rod 33 rearwardly and release the wedges.

In some instances, the forward wedge 31 is coaxially mounted on the after end 37 of the tube 38; and in this construction, the forward wedge 31 is unable to shift transversely. Consequently, as the rod 33 is moved forwardly, the inclined face 29 engages the inclined face 32, causing the forward nose 57 to approach and abut the walls of the tapered throat 18, thereby locking the device in place and preventing removal unless the key 48 is utilized. Here, resilient flexing of the after wedge 28 is again made possible by the considerable clearance between the rod 33 and the walls of the enlarged bore 30 encompassing the rod 33 where the rod passes through the forward wedge 31.

It can therefore be seen that I have provided a gun locking device which is not only simple to operate, but which is reliable and will not fail even under the most severe use.

I claim:

1. A device for locking a gun having a barrel with rifling extending from the muzzle to the throat, said device comprising:

a. a tube insertable in the barrel and extending from the muzzle to the throat;

b. a rod translatable wihin said tube, the after end of said rod extending into the gun chamber to prevent the operation of the gun;

c. a first wedge mounted on said after end of said rod, said wedge having a forwardly facing inclined surface;

d. a second wedge encompassing said rod and located between said first wedge and the after end of said tube, said second wedge having a rearwardly facing inclined surface for engagement with said forwardly facing inclined surface of said first wedge as said rod and said first wedge are urged in a forward direction, said first and said second wedges being thereby biased transversely so that at least one of said wedges is displaced far enough to interfere either with the walls of the throat or the base of the lands at the after end of the rifling; and, e. lock means for selectively translating said rod relative to said tube and urging said first wedge either toward or away from said second wedge.

2. A device as in claim 1 in which said lock means includes a housing; means for mounting said housing on the forward end of said tube; and a cylinder lock enclosed within said housing and connected to said rod for movement thereof as said lock is moved between locked and unlocked position.

3. A device as in claim 2 in which said lock means further includes a pair of mating cams enclosed within said housing, one of said cams being connected to said tube and the other of said cams being connected to said rod, the interengaging faces of said mating cams being inclined so that rotational movement of one of said cams effects relative axial movement therebetween.

4. A device for locking a gun having a barrel with rifling extending from the muzzle to the forward end of the tapered throat, said device comprising:

a. a tube insertable in the barrel and extending substantially the axial length of the rifling;

b. a rod slidably mounted within said tube the after end of said rod extending beyond the after end of said tube into the chamber;

c. a diagonally split sleeve coaxially disposed on said after end of said rod, said sleeve having an after wedge-shaped portion secured to said rod and a forward wedge-shaped portion loosely encompassing said rod to allow transverse movement of said forward portion as said rod is moved forwardly to squeeze said forward portion between said after end of said tube and the diagonal face of said after portion;

d. lock means mounted on the forward ends of said tube and said rod for selectively translating said rod to and fro within said tube between a first rearward position in which said forward portion of said diagonally split sleeve is free to assume a substantially coaxial position on said rod clear of the tapered throat walls and the adjacent lands of the rifling and a second forward position in which said forward portion of said diagonally split sleeve is transversely displaced into interfering relation with respect to the tapered throat and the adjacent lands to prevent withdrawal of said tube from the barrel.

5. A device for locking a gun having a barrel with rifling extending from the muzzle to the freebore, said device comprising:

a. a rod insertable in the barrel and extending between the muzzle and the chamber;

b. a tube loosely encompassing said rod;

c. a diagonally split sleeve having an after portion coaxially secured to said rod and a forward portion loosely encompassing said rod, said after portion of said diagonally split sleeve including a leading nose biased laterally into engagement with at least one of the lands at the start of the rifling as said rod is urged forwardly relative to said tube; and, d. actuating means for selectively moving said rod forwardly and rearwardly.

6. A device as in claim 5 in which said actuating means includes an elongated housing, a cylinder lock closing the forward end of said housing, a plug closing the after end of said housing, and a rotatable and slidable block connected to said rod and interposed between said plug and said lock, said block being in engagement with said lock for rotation thereby and being in camming engagement with said plug for reactive translation as said block is rotated by said lock.

7. A device for locking a gun having a barrel with rifling extending from the muzzle to the freebore, said device comprising:

a. an elongated housing extending from a forward end to an after end;

b. a cylinder lock closing said forward end of said housing;

c. a circular cylindrical plug closing said after end of said housing, the forward end of said plug having a first cam face of predetermined configuration and the after end thereof having a transverse face engageable with the muzzle;

d. a circular cylindrical block coaxially disposed within said housing relative to said plug and said lock, the forward end of said block being in engagement with said lock for rotational movement therewith as said lock is rotated between locked position and unlocked position, and after end of said block having a second cam face of predetermined shape and being in engagement with said first cam face, said interengaging cam faces causing said block to move in a forward direction as said lock is rotated from unlocked position toward locked position;

e. a rod mounted coaxially on said block and extending loosely through a coaxial bore in said plug, the after end of said rod terminating at a location within the chamber of the gun when said transverse face of said plug engages the muzzle;

f. a tube loosely encompassing said rod in coaxial relation, the forward end of said tube being mounted on said plug; and, g. a diagonaly split sleeve having a rearward portion munted coaxially on said after end of said rod with the diagonal surface facing forwardly, the forward portion of said diagonally split sleeve being mounted coaxially on the after end of said tube with the diagonal surface facing rearwardly for sliding engagement with said forwardly facing diagonal surface, said rearward portion of said sleeve being laterally biased out of registry with said forward portion of said sleeve as said rod is urged forwardly by said block in moving in said forward direction as said lock is rotated from unlocked position toward locked position, the laterally biased rearward portion of said sleeve engaging at least one of the lands where the rifling starts at the forward end of the freebore.

* * * * *